United States Patent [19]

Durenec

[11] 4,277,947

[45] Jul. 14, 1981

[54] CRYOGENIC COOLER HAVING TELESCOPING MULTISTAGE REGENERATOR-DISPLACERS

[75] Inventor: Peter Durenec, Annandale, Va.

[73] Assignee: The United States of America as represented by the Secretary of the Army, Washington, D.C.

[21] Appl. No.: 140,939

[22] Filed: Apr. 16, 1980

[51] Int. Cl.[3] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,333,433 | 8/1967 | Chellis | 62/6 |
| 3,372,554 | 3/1968 | Prastet al. | 62/6 |
| 3,383,872 | 5/1968 | Köhler | 62/6 |
| 3,969,907 | 7/1976 | Doody | 62/6 |
| 4,036,027 | 7/1979 | Bamberg | 62/6 |
| 4,060,996 | 8/1977 | Hanson | 62/6 |
| 4,078,389 | 3/1978 | Bamberg | 62/6 |
| 4,143,520 | 3/1979 | Zimmerman | 62/6 |
| 4,206,609 | 6/1980 | Durenec | 62/6 |

*Primary Examiner*—Ronald C. Capossela

*Attorney, Agent, or Firm*—Nathan Edelberg; Milton W. Lee; Max L. Harwell

[57] ABSTRACT

A cryogenic cooler having multistage telescoping in-line regenerator-displacers in which the regenerator-displacer stages are progressively smaller from a pressure wave input end to the output cold end. Each stage from the input toward the output functions to produce a plurality of precooled expansion volumes for progressively lowering the temperatures at the input environment of each subsequent regenerator-displacer stage to maintain a temperature of about 8° Kelvin at the output end of the cooler. Cooling concepts in which the multistage telescoping in-line regenerator-displacer may be used are the integral cycle, the split cycle, and dual fluidly control motion cycle.

20 Claims, 7 Drawing Figures

CRYOGENIC COOLER HAVING TELESCOPING MULTISTAGE REGENERATOR-DISPLACERS

The invention described herein may be manufactured, used, and licensed by the U.S. Government for governmental purposes without the payment of any royalties thereon.

BACKGROUND OF THE INVENTION

1. Field of the Invention

The present invention is in the field of cryogenic cooler multistage regenerator-displacers wherein the various stages are not mechanically linked but move freely due to pressure waves at an input end of the cooler and wherein adjacent displacers telescope with each other.

2. Description of the Prior Art

There is a need in the latest cryogenic cooler systems to provide extremely cold temperatures for a longer period of time than is possible with the latest cooling systems. Problems have existed in previous coolers of excessive wear in the displacer seals caused by low temperature contraction or poor axial alignment and by having a limited frequency cycles of operation which limits the amount of total cooling at the cold end.

SUMMARY OF THE INVENTION

The present invention is comprised of a system of multistage telescoping in-line regenerator-displacer stages for a cryogenic cooler in which there are a plurality of regenerator-displacer stages which are progressively smaller from a pressure wave input end to an output cold end. Each of the progressively smaller regenerator-displacer stages telescope a small limited linear distance within the preceeding larger regenerator-displacer. A plurality of precooled expansion volume cold stations are formed between adjacent stages to provide progressively cooler temperatures at the input environments of each subsequent stage to maintain a temperature of about 8° Kelvin at the output end of the cryogenic cooler.

Some of the novel features of the present system of multistage telescoping in-line regenerator-displacer stages is that there is motion compensation for the physical travel of each regenerator-displacer in accordance with the travel of the pressure waves and the mass flow rates throughout the entire length of the assembly. Each of the stages are self phasing in reference to the input pressure wave intermittent pressure drops through the assembly, are self compensating for mass flow rate, are self adjusting for contraction since the smaller regenerator-displacers are at the colder end of the assembly, and are self aligning with adjacent stages since the regenerator-displacers telescope within, or inside, each other. The telescoping multistage regenerator-displacer assembly may be used with various cryogenic cooler concepts such as, the split cycle, the integral cycle, or the fluidly control motion cycles. The present system is capable of operating at increased frequency from previous coolers, i.e. to about 30 cycles.

The present invention will be better understood with reference to the detailed description and the following Figures.

DETAILED DESCRIPTION OF THE PREFERRED EMBODIMENT

Figure 1:
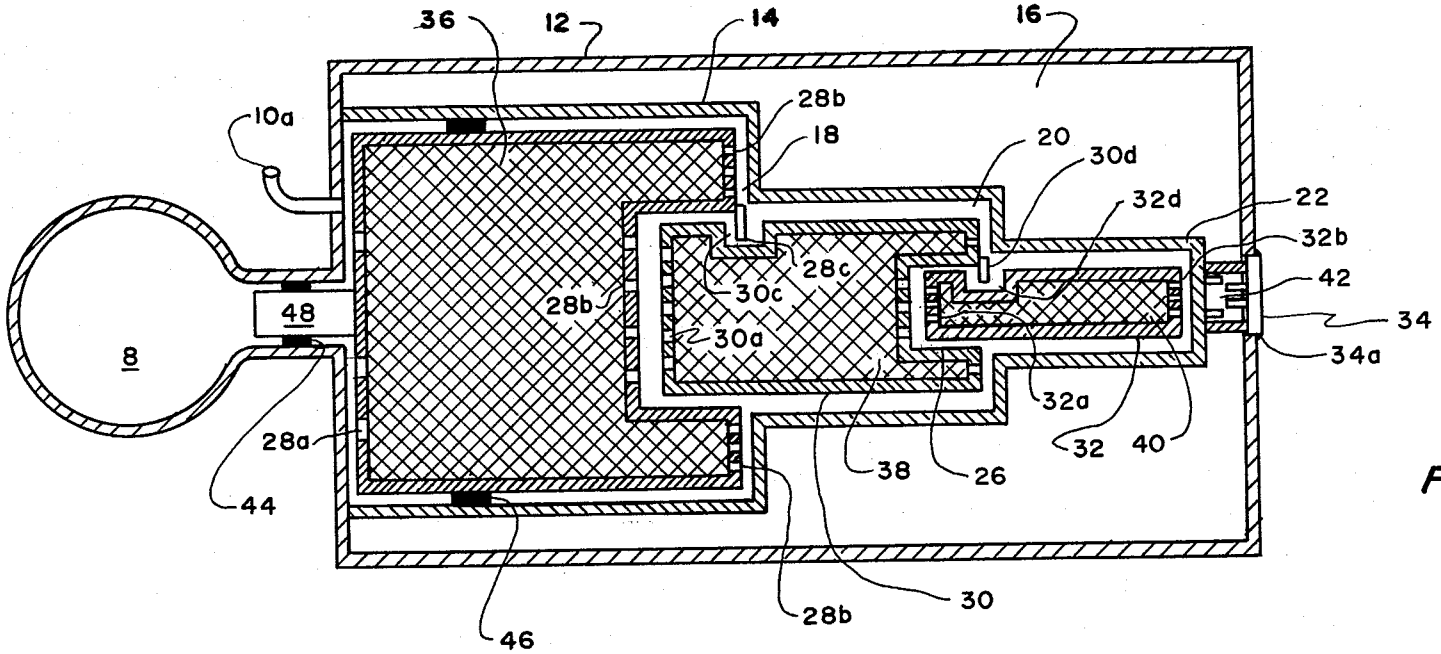
FIG. 1 illustrates the present invention in cross-section except the pressure wave drive means therefor.
Figure 3:
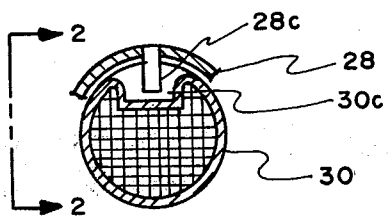
FIG. 3 shows an end view of FIG. 2.
Figure 2:
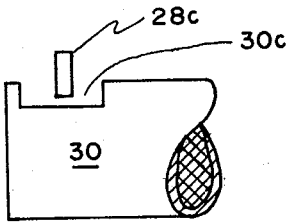
FIG. 2 shows a mechanical stop for the telescoping action of adjacent regenerator-displacer stages and is a side view of FIG. 3.

The present closed cryogenic cooling system, having a telescoping multi-regenerator-displacer assembly for providing and maintaining constant low cryogenic temperatures over a long period of time, is illustrated in FIG. 1 as having three regenerator-displacer stages 28, 30, and 32 within a displacer cylinder 14 and enclosed by a vacuum jacket 12. It is anticipated that the number of stages may be other than three according to size and cooling requirements. The first stage 28 has a pneumatic piston 48 attached thereto, surrounded by an air tight pneumatic piston seal 44, which extends into a bounce space, or pneumatic volume 8. A displacer seal 46 provides a close fit between first stage 28 and displacer cylinder 14. Second and third stage regenerator-displacers 30 and 32 respectively are progressively smaller from the input end on the left side to the output cold end on the right side of FIG. 1. Displacer cylinder 14 also becomes progressively smaller such that there is a close fit, forming clearance seals, between each of the outer walls of the various stages and the inner walls of the displacer cylinder 14. Each of the adjacent of the plurality of regenerator-displacers freely telescope for a limited axial distance with respect to each other. The smaller stages telescope within the larger stages, limited in travel distance therein by mechanical stops, rigidly attached at the output sides of the stages, interacting with slots at the input sides of adjacent stages. These stops and slots are shown in FIGS. 1, 2, and 3 for clarity of their operation, i.e. mechanical stop **28*c* is rigidly attached to first regenerator-displacer 28 and limits the travel of second regenerator-displacer 30 with respect thereto by being limited in travel distance against the end walls of slot 30*c* in the second regenerator-displacer 30. Mechanical stop 30*d* and slot 32*d* interact to limit travel of the third regenerator-displacer 32 within the second regenerator-displacer 30 in like manners. A cooled device 34, typically a detector, is attached by some solder or metallization 34*a* to the vacuum jacket 12 at the output cold end of the telescoping multistage regenerator-displacer assembly. A thermal switch 42, which may be comprised of liquid nitrogen or hydrogen enclosed in a housing having non-touching cooling tubing therein, is connected between the output end of the displacer cylinder 14 and the cooled device 34 to facilitate more efficient cooling. Each of the stages 28, 30, and 32 have input porous plugs 28*a*, 30*a*, and 32*a* respectively, output porous plugs 28*b*, 30*b*, and 32*b* respectively, and screen matrix regenerator materials represented an numerals 36, 38, and 40 respectively. The materials that the displacers of the plurality of regenerator-displacers cylinder 14** are made of have the proper coefficients of thermal expansions that provide constant clearance seals therebetween. As examples, the displacers may be made of nylon or fiber glass and the displacer cylinder may be made of stainless steel or Kovar. The length-to-diameter ratios of the various regenerator-displacers may be, for the first stage a 12:1 ratio, for the second stage a 15:1 ratio, and for the third stage a 30:1 ratio. Using these length-to-diameter ratios, the stroke distances of the various stages may be 5 millimeters for the first regenerator-displacer, 4 millimeters for the second stage, and 3.5 millimeters for the third stages. It should be noted that these stroke distances are calculated for the added contraction at the progressively colder environments.

Figure 4:
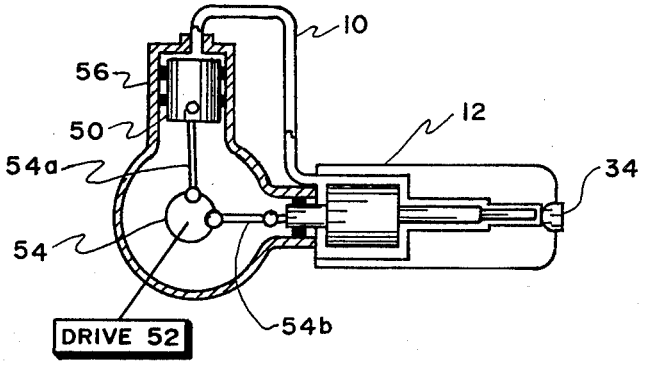
FIG. 4 illustrates an integral Stirling-cycle drive means.
Figure 5:
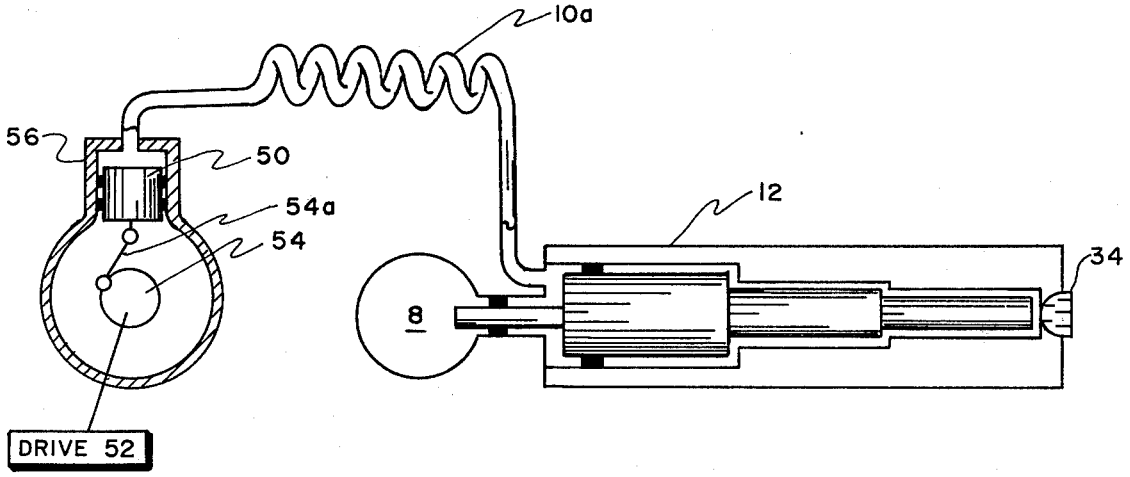
FIG. 5 illustrates a remote split Stirling-cycle drive means.
Figure 6:
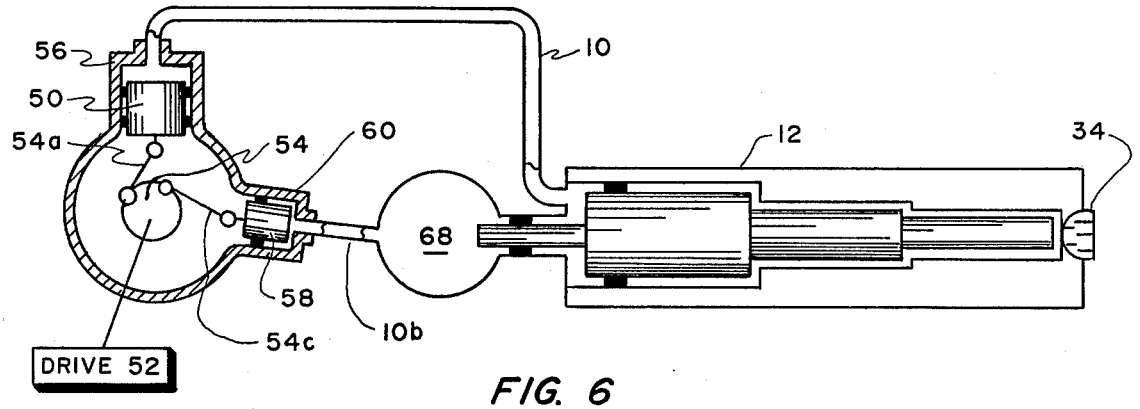
FIG. 6 illustrates a dual fluidically controlled cycle drive means.
Figure 7:
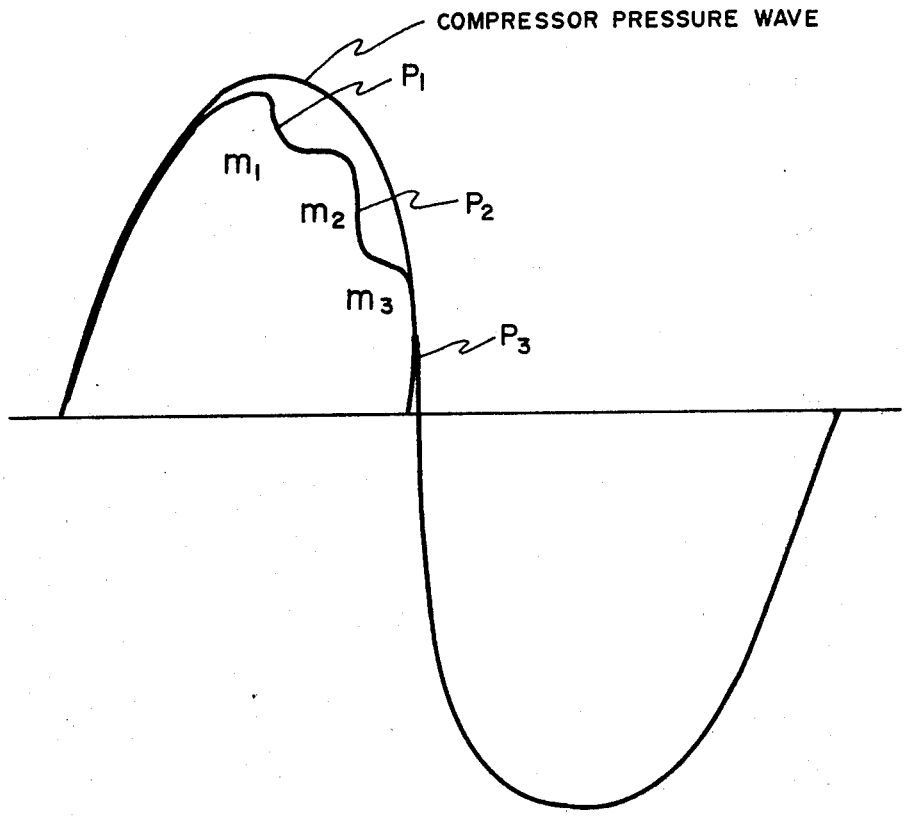
FIG. 7 shows the initial and intermittent pressure waves across various stages.

Refer now to FIGS. 1, 5, and 7 for a description of one means of operation of the present invention. Details of FIGS. 4 and 6 will be described herein below concerning their respective pressure wave producing functions with the telescoping multistage regenerator-displacer assembly. Each of the embodiments of FIGS. 4, 5, and 6 provide a distinctively different working fluid pressure wave producing means for the input to the assembly. The embodiment illustrated by FIG. 5 is a remote split Stirling-cycle drive working fluid pressure wave producing means for imparting alternating pressure waves, such as a train of sinusoidal pressure waves but not limited thereto, to a working fluid, such as helium, enclosed between piston 50 and the working volume within the telescoping multistage regenerator-displacer assembly. The pressure waves are imparted through an inlet connection to the ambient temperature input end of the assembly by way of coiled working fluid remote tubing 10*a*. Tubing is coiled between the pressure wave producing means and the assembly to provide a heat exchanger, to eliminate transient vibrations, and for design flexibility. Piston 50 is reciprocated within cylinder 56 by a mechanical drive means 52 such as a motor drive crankshaft 54 having a connecting rod 54*a* connected to the piston. The alternating pressure waves preferably alternate about a median 300 pounds per square inch pressure in which each of the individual pressure waves has intermittent pressure drops and reduced mass working fluid flow rates from the maximum pressure at the input end of the assembly across each of the plurality of regenerator-displacers to the output cold end of the assembly. FIG. 7 illustrates these typical intermittent pressure drops and reduced working fluid flow rates as $P_1$ and $M_1$ respectively for the first stage, $P_2$ and M2 respectively for the second stage, and $P_3$ and M3 respectively for the third stage. There is motion compensation for physical travel for each of the stages in accordance with the pressure drops and reduced flow rates caused by the traveling phase shift of each alternating, or sinusoidal pressure wave. The traveling phase shift of each sinusoidal pressure wave is 90° for the first stage at its input end, 82° for the second stage input end, and 70° for the third stage input end. This progressive traveling phase shift of the subsequent stages compensate for the progressively denser working fluid as the working fluid approaches the output cold end.

As the working fluid has the alternating pressure waves applied thereto, the various stages begin to telescope within each other back and forth. As the stages telescope a plurality of precooled cold station expansion volumes between adjacent stages are intermittently formed. These precooled cold station expansion volumes shuttle heat transfer in an axial temperature gradient along the length of the telescoping multistage regenerator-displacer assembly to progressively lower the temperature of the input environments of each regenerator-displacer. These expansion volumes are indicated as a first expansion volume 24 between the first and second stages and a second expansion volume 26 between the second and third stages. Numerals 18, 20, and 22 also represent a plurality of cold stations where the progressively cooler input environments are located. Typically, the temperatures at the first cold station 18 is about 80° Kelvin, at the second cold station 20 is about 20° Kelvin, and at the third cold station 22, which is also at the output of the third stage regenerator-displacer, the temperature is about 8° Kelvin.

FIG. 4 illustrates an integral Stirling-cycle drive working fluid pressure wave producing means comprised of two pressure wave producing means. One of the pressure wave producing means is a fluidic compression means comprised of a working fluid drive piston 50, in cylinder 56, that is driven by a connecting rod 54*a* attached to the rotating crankshaft 54 which impacts pressure waves to the working fluid in remote tubing 10 and to the working fluid within the assembly by way of the input side of the first of said plurality of regenerator-displacers. The other pressure wave producing means is a mechanical compression means comprised of a connecting rod 54*b* that is connected to the end of the pneumatic piston 48 which is attached to the first regenerator-displacer wherein the other end of connecting rod 54*b* is attached to the rotating crankshaft 54 in quadrature with connecting rod 54*a*, i.e. 90° ahead thereof. With this quadrature connection of the connecting rods both pressure wave producing means compensate the action of each other as to imparting motion to said plurality of regenerator-displacers, i.e. both will be imparting compressions and likewise expansions at the same instant.

FIG. 6 illustrate another version of the working fluid pressure wave producing means, in this instance a dual fluidically controlled compression input means wherein each compression input means has a closed working fluid volume. One of the dual fluidically controlled compression input means is the same as for the working fluid drive pistons 50 of both the split Stirling-cycle and the integral Stirling-cycle as shown in FIGS. 5 and 4 respectively. That is, the closed working fluid volume is comprised of tubing 10*a* and 10 connected to the input side of said first regenerator-displacer and the entire working volume within the assembly. A second dual fluidically controlled compression input means is comprised of a second working fluid drive piston 48, within cylinder 60 and connected in quadrature with connecting rod 54*a* by its own connecting rod 54*c* to a rotating crankshaft 54, which encloses a working fluid volume between piston 58 and the end of pneumatic piston 48 which extends from the first regenerator-displacer into a fluidic volume 68, wherein the closed working fluid volume is comprised of the volume within tubing 10*b* and a fluidic volume 68. Piston 58 is smaller than piston 50. With the crankshaft rotating and connecting rods 54*a* and 54*c* connected in quadrature, motion of said plurality of regenerator-displacers is directly compensated for by the dual fluidically controlled compression input means.

I claim:

1. In a closed cryogenic cooling system comprised of a telescoping multistage regenerator-displacer assembly for providing constant low cryogenic temperatures; the system comprising:

a working fluid pressure wave producing means for imparting pressure waves to a working fluid at an input end of said telescoping multistage regenerator-displacer assembly; and a plurality of regenerator-displacers within a displacer cylinder that is enclosed by a vacuum jacket in which said plurality of regenerator-displacers are progressively smaller from said input end to an output cold end of said telescoping multistage regenerator-displacer assembly wherein each of the progressively smaller adjacent regenerator-displacers of said plurality of regenerator-displacers freely telescope for a limited axial distance within the preceeding larger regenerator-displacer in response to alternating pressure waves imparted to said working fluid by said working fluid pressure wave producing means with the outer surfaces of each of said plurality of regenerator-displacers fitting snugly with the inner surfaces of said displacer cylinder to provide clearance seals therebetween in which a plurality of precooled cold station expansion volumes between adjacent regenerator-displacers are intermittently formed by telescoping action therebetween wherein said plurality of precooled cold station expansion volumes shuttle heat transfer in an axial temperature gradient along the length of said telescoping multistage regenerator-displacer assembly to progressively lower the temperature of the input environments of each regenerator-displacer of said assembly to maintain a constant low cryogenic temperature at said output cold end.

2. A cryogenic cooling system as set forth in claim 1 wherein the regenerator material in said plurality of regenerator-displacers in a screen matrix and the materials of the displacers of said plurality of regenerator-displacers and said displacer cylinder having coefficients of thermal expansions that provide constant clearance seals therebetween.

3. A cryogenic cooling system as set forth in claim 2 wherein said working fluid pressure wave producing means imparts to said working fluid a train of sinusoidal pressure waves about a median 300 pounds per square inch pressure in which each sinusoidal pressure wave has intermittent pressure drops and reduced mass working fluid flow rates from the maximum pressure at the input end across each of said plurality of regenerator-displacers to said output cold end.

4. A cryogenic cooling system as set forth in claim 3 wherein there is motion compensation for physical travel of said plurality of regenerator-displacers in accordance with said intermittent pressure drops and reduced mass working fluid flow rates caused by the traveling phase shift of each sinusoidal pressure wave.

5. A cryogenic cooling system as set forth in claim 4 wherein said plurality of regenerator-displacers is three.

6. A cryogenic cooling system as set forth in claim 5 wherein said traveling phase shift of each sinusoidal pressure wave is 90° for the first regenerator-displacer at said input end and 82° for the second regenerator-displacer and 70° for the third regenerator-displacer to compensate for the progressively denser working fluid at said plurality of precooled station expansion volumes from said input end to said output cold end.

7. A cryogenic cooling system as set forth in claim 6 wherein said working fluid is helium.

8. A cryogenic cooling system as set forth in claim 7 wherein the length-to-diameter ratios and stroke distances of said three regenerator-displacers is for said first regenerator-displacer a 12:1 length-to-diameter ratio and a stroke distance of 5 millimeter, and for said second regenerator-displacer a 15:1 length-to-diameter ratio and a stroke distance of 4 millimeter, and for said third regenerator-displacer a 30:1 length to diameter ratio and a stroke distance of 3.5 millimeters.

9. A cryogenic cooling system as set forth in claim 8 wherein the displacer of said plurality of regenerator-displacers is made of fiber glass.

10. A cryogenic cooling system as set forth in claim 9 wherein said displacer cylinder is made of stainless steel.

11. A cryogenic cooling system as set forth in claim 9 wherein the displacer cylinder is made of Kovar.

12. A cryogenic cooling system as set forth in claim 8 wherein the displacers of said plurality of regenerator-displacers is made of nylon.

13. A cryogenic cooling system as set forth in claim 12 wherein said displacer cylinder is made of stainless steel.

14. A cryogenic cooling system as set forth in claim 13 wherein said working fluid pressure wave producing means is a remote split Stirling-cycle drive.

15. A cryogenic cooling system as set forth in claim 13 wherein said working fluid pressure wave producing means is an integral Stirling-cycle drive comprised of a fluidic compression means for producing pressure waves in said working fluid and a mechanical compression means connected to a pneumatic piston attached at the input side of the first of said plurality of regenerator-displacers wherein said fluidic compression means and said mechanical compression means are operated in quadrature by a mechanical drive means to directly compensate for the motion inparted to said plurality of regenerator-displacers.

16. A cryogenic cooling system as set forth in claim 15 wherein said mechanical drive means is a motion driven crankshaft drive having two connecting rods connected in quadrature thereto and said fluidic compression means is comprised of one of said two connecting rods attached to a working fluid drive piston that imparts working fluid pressure waves at said input end of said telescoping multistage regenerator-displacer assembly and said mechanical compression means is comprised of a second of said two connecting rods directly connected to said pneumatic piston.

17. A cryogenic cooling system as set forth in claim 13 wherein said working fluid pressure wave producing means is comprised of dual fluidically controlled compression input means to said telescoping multistage regenerator-displacer assembly each having closed working fluid volumes wherein one of said dual fluidically controlled compression input means has a tubing closed working fluid volume between a first working fluid drive piston and the input side porous plugs of said first regenerator-displacer and wherein a second of said dual fluidically controlled compression input means has tubing and fluidic volume closed working fluid volume between a second working fluid drive piston and a pneumatic piston on said first regenerator-displacer that extends into said fluidic volume wherein said first and second pistons are driven in quadrature by a mechanical drive means to directly compensate for the motion imparted to said plurality of regenerator-displacers.

18. A cryogenic cooling system as set forth in claim 17 wherein the diameter of said first working fluid driven piston is greater than the diameter of said second working fluid drive piston.

19. A cryogenic cooling system as set forth in claim 18 wherein said mechanical drive means is a crankshaft drive having two connecting rods connected in quadrature thereto that are attached to said first and second working fluid drive pistons to impart compensating working fluid pressure waves at the input end of said telescoping multistage regenerator-displacer assembly.

20. A cryogenic cooling system as set forth in claim 12 wherein said displacer cylinder is made of Kovar.

* * * * *